US006752698B1

(12) United States Patent
Renteln et al.

(10) Patent No.: US 6,752,698 B1
(45) Date of Patent: Jun. 22, 2004

(54) METHOD AND APPARATUS FOR CONDITIONING FIXED-ABRASIVE POLISHING PADS

(75) Inventors: Peter Renteln, Sam Ramon, CA (US); Alan J. Jensen, White Salmon, WA (US); David S. Lamb, Indianapolis, IN (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/100,740

(22) Filed: Mar. 19, 2002

Related U.S. Application Data

(60) Provisional application No. 60/277,342, filed on Mar. 19, 2001.

(51) Int. Cl.[7] ..... B24B 1/00

(52) U.S. Cl. ..... 451/56; 451/72

(58) Field of Search ..... 451/56, 443, 444, 451/41, 72, 67

(56) References Cited

U.S. PATENT DOCUMENTS

| | | | |
|---|---|---|---|
| 3,753,269 | A | 8/1973 | Budman |
| 4,318,250 | A | 3/1982 | Klievoneit et al. |
| 4,672,985 | A | 6/1987 | Mohr |
| 4,720,939 | A | 1/1988 | Simpson et al. |
| 4,934,102 | A | 6/1990 | Leach et al. |
| 5,081,051 | A | 1/1992 | Mattingly et al. |
| 5,335,453 | A | 8/1994 | Baldy et al. |
| 5,484,323 | A | 1/1996 | Smith |
| 5,527,424 | A | 6/1996 | Mullins |
| 5,531,635 | A | 7/1996 | Mogi et al. |
| 5,536,202 | A | 7/1996 | Appel et al. |
| 5,547,417 | A | 8/1996 | Breivogel et al. |
| 5,558,568 | A | 9/1996 | Talieh et al. |
| 5,575,707 | A | 11/1996 | Talieh et al. |
| 5,593,344 | A | 1/1997 | Weldon et al. |
| 5,611,943 | A | 3/1997 | Cadien et al. |

(List continued on next page.)

FOREIGN PATENT DOCUMENTS

| | | |
|---|---|---|
| WO | WO 98/45090 | 10/1998 |
| WO | WO 99/22908 | 5/1999 |
| WO | WO 01/32360 A1 | 5/2001 |

OTHER PUBLICATIONS

S. Inaba, T. Katsuyama, M. Tanaka, "Study of CMP Polishing pad Control Method," 1998 CMP–MIC Conference, Feb. 19–20, 1998, 1998 IMIC—300P/98/0444.

U.S. patent application Ser. No. 09/540,602, filed Mar. 30, 2000, entitled: "Method and Apparatus for Conditioning a Polishing Pad".

U.S. patent application Ser. No. 09/607,743, filed Jun. 30, 2000, entitled "A Conditioning Mechanism in a Chemical Mechanical Polishing Apparatus for Semiconductor Wafers".

U.S. patent application Ser. No. 10/039,749, filed Oct. 26, 2001, entitled "Method and Apparatus for Controlling CMP Pad Surface Finish".

*Primary Examiner*—Dung Van Nguyen
(74) *Attorney, Agent, or Firm*—Brinks Hofer Gilson & Lione

(57) ABSTRACT

A method and apparatus for conditioning a fixed-abrasive polishing pad used in chemical mechanical planarization of semiconductor wafers is described. The apparatus includes a conditioning member having a smooth surface. The method includes providing a conditioning member having a smooth surface, pressing the conditioning member against the fixed-abrasive polishing pad, and moving the fixed-abrasive polishing pad. In one embodiment, the method further comprises moving the conditioning member perpendicular to the direction of movement of the fixed-abrasive pad to compensate for variations in amounts of exposed abrasive on the fixed-abrasive pad.

20 Claims, 4 Drawing Sheets

U.S. PATENT DOCUMENTS 5,622,526 A 4/1997 Phillips
5,643,044 A 7/1997 Lund
5,655,951 A 8/1997 Meikle et al.
5,692,947 A 12/1997 Talieh et al.
5,692,950 A 12/1997 Rutherford et al.
5,725,417 A 3/1998 Robinson
5,759,918 A 6/1998 Hoshizaki et al.
5,762,536 A 6/1998 Pant et al.
5,779,526 A 7/1998 Gill
5,782,675 A * 7/1998 Southwick ..... 451/41
5,871,390 A 2/1999 Pant et al.
5,897,426 A 4/1999 Somekh
5,899,798 A 5/1999 Trojan et al.
5,908,530 A 6/1999 Hoshizaki et al.
5,958,794 A 9/1999 Bruxvoort et al.
5,990,010 A 11/1999 Berman
6,086,460 A 7/2000 Labunsky et al.
6,244,935 B1 * 6/2001 Birang et al. ..... 451/41
6,273,798 B1 8/2001 Berman
6,300,247 B2 10/2001 Prabhu
6,306,008 B1 * 10/2001 Moore ..... 451/56
6,306,019 B1 10/2001 Finkelman
6,322,427 B1 * 11/2001 Li et al. ..... 451/56
6,328,637 B1 12/2001 Labunsky et al.
6,361,414 B1 3/2002 Ravkin et al.
6,447,374 B1 * 9/2002 Sommer et al. ..... 451/56

* cited by examiner

METHOD AND APPARATUS FOR CONDITIONING FIXED-ABRASIVE POLISHING PADS

CROSS-REFERENCE TO RELATED APPLICATIONS

This application claims the benefit of U.S. provisional application Ser. No. 60/277,342, filed Mar. 19, 2001, the entire disclosure of which is incorporated herein by reference.

FIELD OF THE INVENTION

The present invention relates to a method and apparatus for conditioning a polishing pad. More particularly, the present invention relates to a method and apparatus for conditioning a fixed-abrasive polishing pad used in the chemical mechanical planarization of semiconductor wafers.

BACKGROUND

Semiconductor wafers are typically fabricated with multiple copies of a desired integrated circuit design that will later be separated and made into individual chips. A common technique for forming the circuitry on a semiconductor wafer is photolithography. Part of the photolithography process requires that a special camera focus on the wafer to project an image of the circuit on the wafer. The ability of the camera to focus on the surface of the wafer is often adversely affected by inconsistencies or unevenness in the wafer surface. This sensitivity is accentuated with the current drive for smaller, more highly integrated circuit designs which cannot tolerate certain nonuniformities within a particular die or between a plurality of dies on a wafer. Because semiconductor circuits on wafers are commonly constructed in layers, where a portion of a circuit is created on a first layer and conductive vias connect it to a portion of the circuit on the next layer, each layer can add or create nonuniformity on the wafer that must be smoothed out before generating the next layer.

Chemical mechanical planarization (CMP) techniques are used to planarize the raw wafer and each layer of material added thereafter. Available CMP systems, commonly called wafer polishers, often use a rotating wafer holder that brings the wafer into contact with a polishing pad moving in the plane of the wafer surface to be planarized. In some systems, a polishing fluid, such as a chemical polishing agent or slurry containing microabrasives, is applied to the polishing pad to polish the wafer. The wafer holder then presses the wafer against the rotating polishing pad and is rotated to polish and planarize the wafer. In other CMP systems, a fixed-abrasive polishing pad is used to polish the wafer. In fixed-abrasive applications, the wafer holder presses the wafer against the rotating fixed-abrasive polishing pad, deionized water (or some other non-abrasive substance) is applied, and the pad is rotated to polish and planarize the wafer. Some available wafer polishers use a linear belt rather than a rotating surface to carry the polishing pad.

With use, the polishing pads used in standard, abrasive/chemical slurry CMP systems become smoothed and clogged with used slurry and debris from the polishing process. The accumulation of debris reduces the surface roughness and adversely affects polishing rate and uniformity. Polishing pads are typically conditioned to roughen the pad surface, provide microchannels for slurry transport, and remove debris or byproducts generated during the CMP process. Standard methods for conditioning this type of polishing pad may use a rotary disk embedded with diamond particles to roughen the surface of the polishing pad.

CMP systems using a fixed-abrasive pad generally require the presence of features on the semiconductor wafer to function. One type of fixed-abrasive pad includes abrasive particles embedded within a polymer matrix. With this type of fixed-abrasive polishing pad, a patterned semiconductor wafer conditions the fixed-abrasive pad as it is polished by using the topography features created by the etching and deposition processes on the semiconductor wafer to remove a portion of the polymer matrix, thus exposing the abrasive particles embedded within. In fact, a patterned semiconductor wafer is sometimes used to pre-condition a pad. These wafers, sometimes referred to as dummy patterned wafers, can cost a considerable amount of money to manufacture, and the loading of these dummy wafers onto a CMP system may take up a considerable amount of time.

Another difficulty encountered with fixed-abrasive pads is the uneven polishing rate and polishing uniformity that can develop on a wafer-to wafer basis. Because a circular wafer presents more length of surface with topography in the center than at the edges, the wafer tends to expose abrasives on the pad surface at an uneven rate from the center to the edge of the wafer. Thus, an inconsistent polish result can occur, and become more pronounced, as a fixed abrasive polishing pad is used with consecutive wafers. One way to condition the fixed-abrasive pad is to use a standard abrasive-type conditioner to try and attain a desired amount of exposed abrasive. A drawback of this method is the difficulty in controlling the resulting roughness. Another possible method for improving polishing pad performance is to fabricate a fixed-abrasive polishing pad having an abrasive matrix that is different in the center than at the edges in order to compensate for the center-to-edge effects. A drawback of this technique is that such a variable abrasive pad may be difficult and expensive to produce.

Accordingly, further development of an apparatus and method for conditioning a fixed-abrasive pad used in the chemical mechanical planarization of semiconductor wafers is necessary in order to decrease the cost and time for conditioning a fixed-abrasive pad.

DETAILED DESCRIPTION OF THE PRESENTLY PREFERRED EMBODIMENTS

Figure 1:
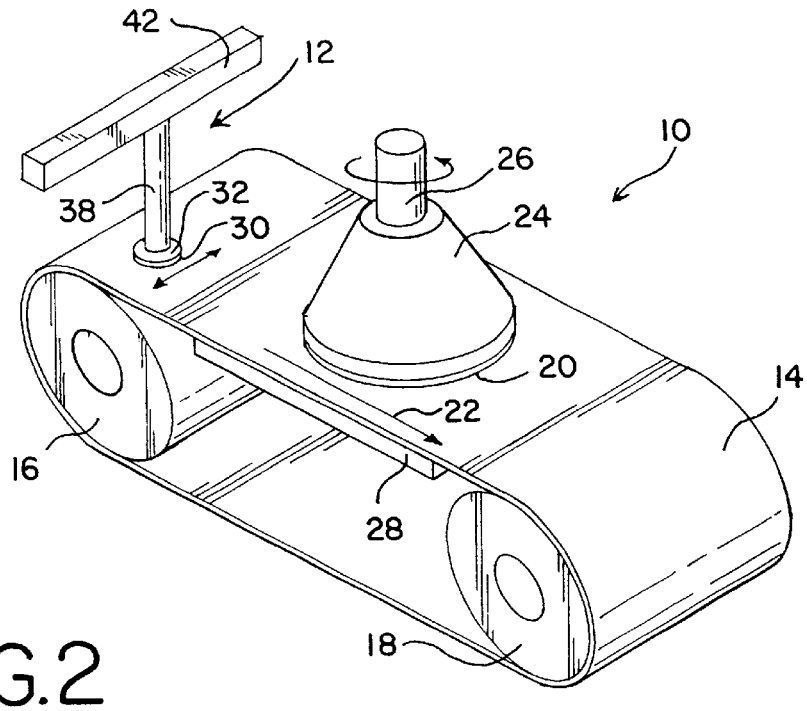
FIG. 1 is a perspective view of a linear polishing system for polishing or planarizing a semiconductor wafer incorporating a fixed-abrasive polishing pad conditioner according to a preferred embodiment.

In order to address the drawbacks of the prior art described above, a method and apparatus for conditioning a fixed-abrasive polishing pad are described herein that are intended to improve the ability to maintain polishing rate and polishing uniformity in a CMP process. Referring to FIG. 1, a linear polisher 10 is shown that is suitable for use with a preferred embodiment of a fixed-abrasive pad conditioner 12. The linear polisher 10 includes a belt assembly 14 having a fixed-abrasive polishing pad. The belt assembly 14 may consist of an integrally molded belt and fixed-abrasive pad combination or a belt having separate fixed-abrasive polishing pad and belt components attached in any one of a number of ways known in the art. The linear polisher 10 moves the belt assembly 14 linearly around rollers 16, 18 by actively driving one or both of the rollers 16, 18 with a driving mechanism such as a motor. In this manner, the fixed-abrasive polishing pad on the belt 14 moves past the surface of the wafer 20 in a linear fashion. A direction of movement of the belt assembly 14 is indicated by arrow 22.

A wafer carrier 24, driven by a spindle 26, holds the wafer 20 against the polishing pad on the belt 14. A spindle drive mechanism (not shown) applies rotational and axial force to the spindle 26 so that the wafer 20 is rotated and pressed against the fixed-abrasive pad on the belt assembly 14. A platen 28 positioned underneath the belt assembly 14 and opposite the wafer carrier 24 supports the belt assembly with a fluid bearing to provide a very low friction surface that can be adjusted to compensate for polishing variations. Suitable linear polishers include the linear polishers in the TERES CMP System available from Lam Research Corporation of Fremont, Calif.

Figure 2:
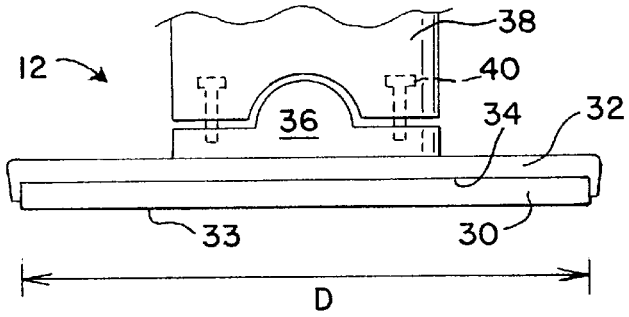
FIG. 2 is perspective view of the fixed-abrasive polishing pad conditioner in FIG. 1.
Figure 2A:
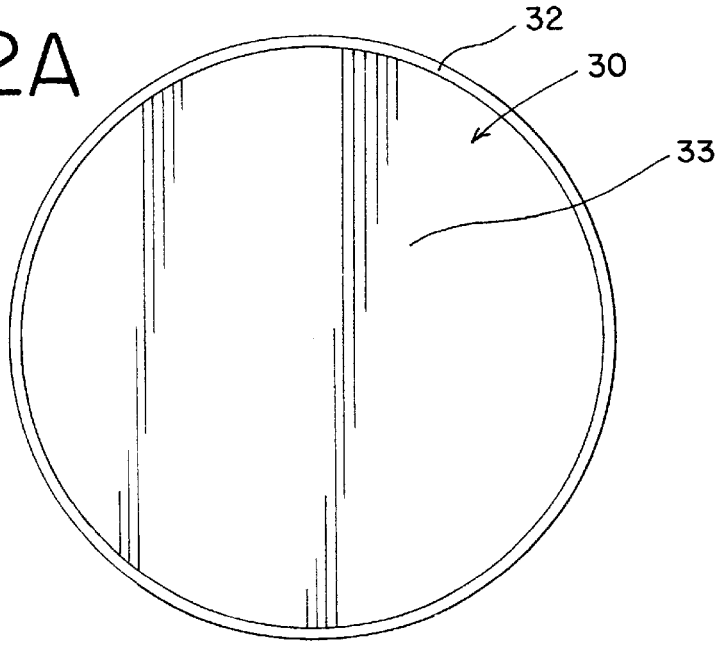
FIG. 2A is a bottom plan view of the fixed-abrasive polishing pad conditioner of FIG. 2.
Figure 3:
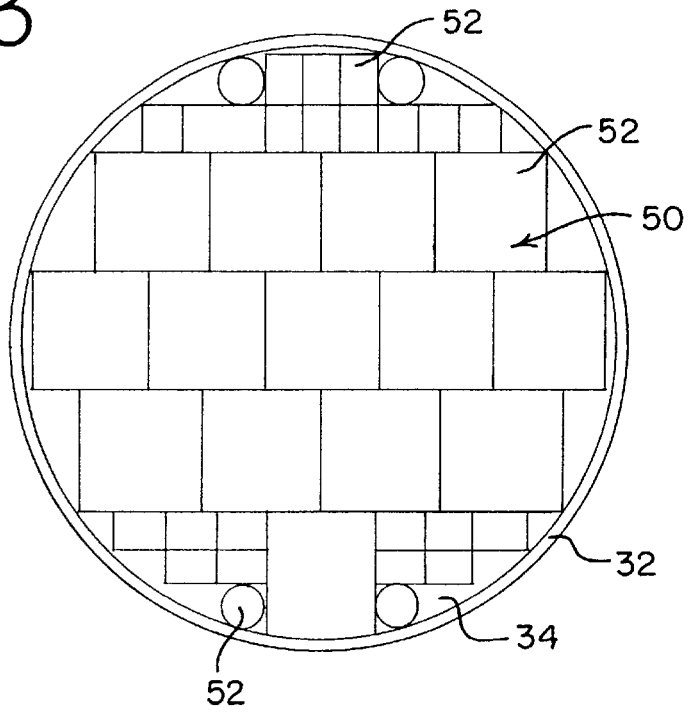
FIG. 3 is an alternative embodiment of the fixed-abrasive polishing pad conditioner of FIGS. 2 and 2A.

As shown in FIGS. 2 and 2A, a preferred embodiment of a pad conditioner 12 for fixed-abrasive polishing pads includes a conditioning member 30 attached to a pad conditioner carrier 32 having a non-abrasive, mirror finish, surface 33 oriented to contact a fixed-abrasive polishing pad. The pad conditioning member 30 is preferably formed in a single disk or puck-shaped component having an unbroken surface. In alternative embodiments, the pad conditioning member may include multiple discrete components, in any one of a variety of individual shapes, that are juxtaposed to form the conditioning member. An alternative embodiment of the pad conditioning member 50 composed of various components is illustrated in FIG. 3. In this embodiment, the conditioning member 50 includes a series of components 52 in the shape of bars and/or discs that are combined together and placed adjacent to each other in order to approximate the shape and size of a larger structure such as the disk of FIG. 2. As with the embodiment of FIG. 2, each surface of the multiple components is preferably non-abrasive and mirror smooth so as to be useful in wearing down exposed abrasive without removing fixed-abrasive matrix material and exposing fresh abrasive. In other preferred embodiments, the pad conditioning member 30, 50 may be in the shape of a bar or other geometric shape. In yet other embodiments, the conditioning member 30, 50 is structured in order to approximate the shape and size of a semiconductor wafer.

As provided above, and in contrast with the commonly available abrasive conditioners, the pad conditioning member 30, or the discrete components that make up a conditioning member 50, may be constructed of any material having a smooth, unbroken surface. Preferably, the pad conditioning member is constructed of a material capable of maintaining a mirror smooth surface but that is suitable for wearing down abrasive particles from the fixed-abrasive pad without removing the matrix material of the pad and exposing new abrasive particles. Examples of suitable materials include silicon oxide ($SiO_2$), silicon carbide (SiC), and any material with a density and hardness similar to silica, such as, for example, borosilicate glass, soda lime glass, and high-lead glass. Other materials, such as SiN, $Al_2O_3$, $Ce_2O_3$, MgO or other oxides are also suitable. Although other smoothness and total indicated runout (TIR) ranges may be used, the conditioning element has an $R_a$ of approximately 5–50 Angstroms, and a TIR of approximately 400 Angstroms in one preferred embodiment. Because the conditioning element is expected to become smooth with use, the exact material and flatness may be varied.

The pad conditioning member 30 is mounted or attached onto the pad conditioner carrier 32, as illustrated in FIG. 2. Preferably, the pad conditioning member 30 is attached to the pad conditioner carrier 32 using any attachment means know to those of skill in the art, such as a retaining ring, a hook and loop type fastener (such as VELCRO™), a screw, a belt, a cable, a snap-fit member, an adhesive, a captivating spring, or any other type of means for attaching one member to a second member. In one embodiment, the pad conditioning member 30 is removably attached to pad conditioner carrier 32, however, the pad conditioning member 30 may be fixedly attached to the pad conditioner carrier 32. The pad conditioner carrier 32 defines a cavity 34 within which the pad conditioning member 30 rests.

Preferably, the pad conditioner carrier 32 is connected to a gimbal 36 that is used to maintain the pad conditioner carrier 32 and pad conditioning member 30 parallel to the fixed-abrasive pad surface when the pad conditioner carrier is connected with a gimbal shaft 38 and pressed against the fixed-abrasive pad. The gimbal 36 may be connected with the gimbal shaft 38 through a series of bolts 40. The bolts 40 secure the gimbal 36 to the gimbal shaft 38 while allowing some freedom of motion between the gimbal and gimbal shaft. The gimbal shaft 38 is preferably connected with an actuator mechanism 42 (FIG. 1), that transports the gimbal shaft in a transverse direction to the linear direction 22 traveled by the belt assembly 14 and applies a downward force on the gimbal shaft 38 against the belt assembly 14. Suitable devices for providing the transverse motion component and the downforce component of the actuator mechanism include linear motors, lead screws, piston and cylinder assemblies, and other electrical or mechanical actuating devices. In another preferred embodiment, the actuator mechanism 42 may also rotate the gimbal shaft 38 while maintaining a downward pressure against the belt assembly and moving the pad conditioning member transverse to the rotational direction of the belt.

Figure 5:
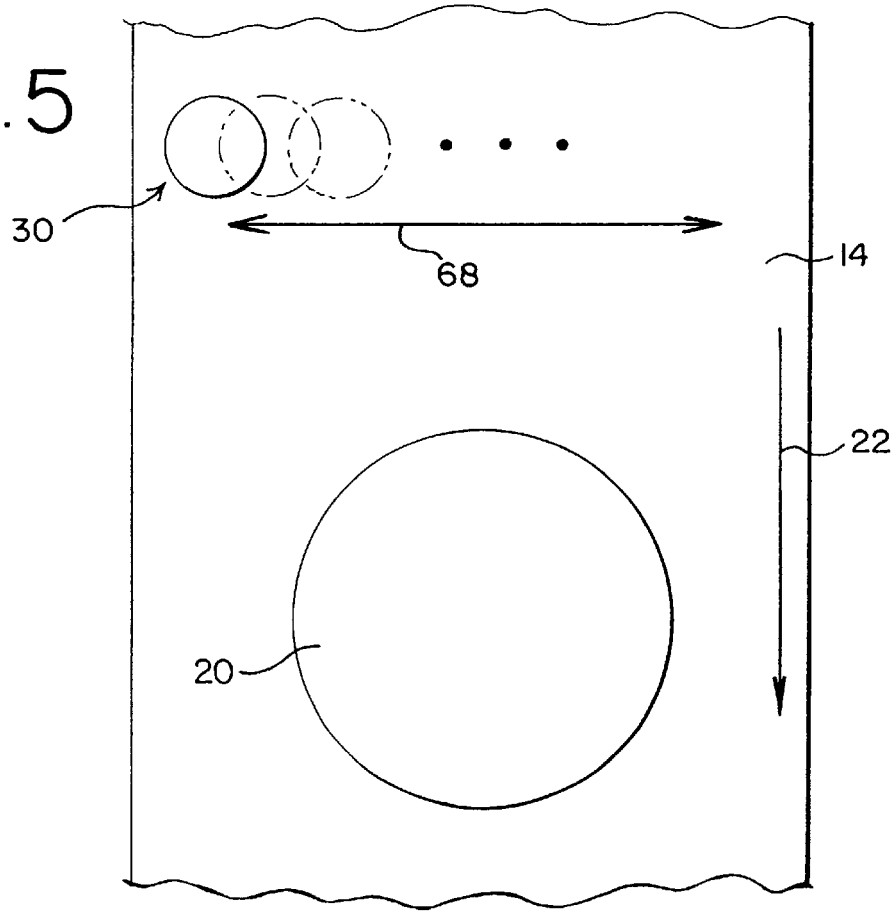
FIG. 5 is a section top view of the linear polishing system of FIG. 1 illustrating a preferred method of conditioning the polishing pad.

In operation, the pad conditioning member 30 is in direct contact with a portion of the surface of fixed-abrasive polishing pad 28, as illustrated in FIGS. 1 and 5. The pad conditioning member 30 has a width or diameter D defined as the distance from one end of the pad conditioning member 30 to the other, as illustrated in FIG. 2. According to a first preferred embodiment, the pad conditioning member 30 has a width or diameter D that is less than the diameter of the semiconductor wafer 20. In this embodiment, the pad conditioner 12 can be introduced into the linear polisher 10 without taking up substantial space. In one preferred embodiment, the pad conditioning member 30 has a width or diameter D that is between about 4 centimeters to about 8 centimeters. In another preferred embodiment, the pad conditioning member 30 has a width or diameter D that is substantially equal to the diameter of the semiconductor wafer. Preferably, the pad conditioning member 30 has a generally circular footprint on the fixed-abrasive polishing pad, as illustrated in FIG. 1. However, as would be appreciated by those of ordinary skill in the art, the pad conditioning member 30 can form footprints with a variety of shapes such as a rectangular shape, a square shape, a v-shape, a w-shape, a u-shape, and any other regular or irregularly shaped footprint over the fixed-abrasive polishing pad 28.

Figure 4:
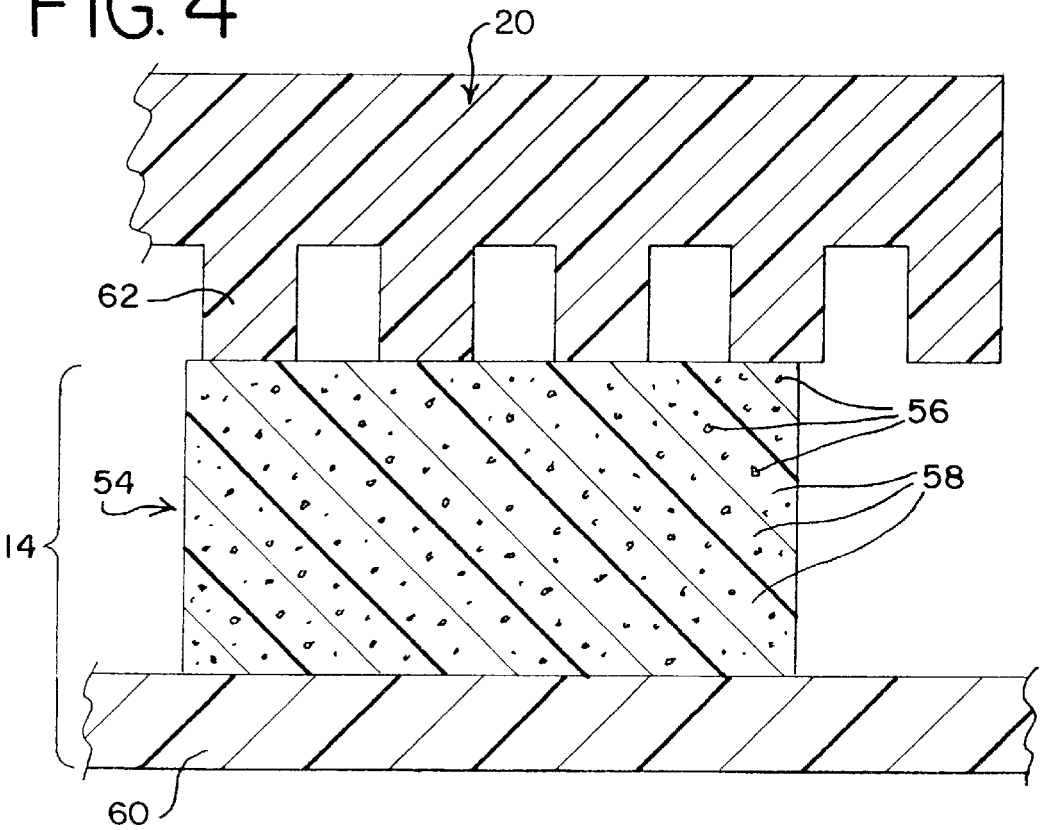
FIG. 4 is a magnified view of a fixed-abrasive polishing pad polishing a semiconductor wafer.

Utilizing the apparatus described above, a preferred embodiment of a method for conditioning a fixed-abrasive polishing pad will now be discussed. As shown in FIG. 4, the fixed-abrasive pad of the belt assembly 14 may be constructed of individual columns 54 of an abrasive mix consisting of abrasive particles 56 trapped in a polymer matrix 58. The columns 54 may be supported on a layer 60 made of mylar or other material. Suitable fixed-abrasive pad material is available from 3M of St. Paul, Minn. It has been observed that planarizing semiconductor wafers with a linear belt assembly, such as illustrated in FIG. 1, with a fixed-abrasive pad configured as in FIG. 4, results in a removal rate near the edge of the wafer that decreases with respect to the rate at the center of the wafer, on a wafer-to-wafer basis, while the overall rate increases. This result is attributed to the mechanism by which the fixed-abrasive technology is believed to operate. Referring to FIG. 4, with fixed-abrasive polishing pads, the act of polishing a patterned wafer increases the removal rate because the topography 62 of the devices fabricated on the wafer removes polymer matrix material 58 from the pad, thus revealing more hard, abrasive particles. Also, because the wafer is circular, the center of the pad sees more of the wafer topology than the edge of the pad, and more abrasives are exposed. Thus, on a wafer-by-wafer basis, the removal rate at the center of the wafer increases compared to the removal rate at the edges of the wafer, resulting in a degradation of removal uniformity.

To correct for the uneven exposure rate of abrasive particles from the center to the edge of the wafer, the mirror finish pad conditioning member of the pad conditioner is rubbed over the fixed-abrasive material. The smooth pad conditioning member is used to wear down the abrasive particles already exposed by the action of the patterned devices on the wafer against the pad, while preferably avoiding exposing any additional abrasive particles. Thus, unlike pad conditioners in abrasive slurry CMP applications, where highly abrasive pad conditioners (e.g. with diamond grit) are used to abrade the polishing pad surface, an embodiment of the present invention utilizes a smooth surfaced pad conditioning member to wear away at the abrasive particles on the fixed-abrasive pad surface. Preferably, by wearing down the abrasive particles in a manner to compensate for the circular shape of the wafer, the removal rate within a wafer and on a wafer-to-wafer basis is kept more uniform.

Preferably, the pad conditioner 12 implements a zonal conditioning technique on the linear polisher. Zonal conditioning provides a method to spend more time conditioning the pad at the center of the wafer track than at the edge of the wafer track in order to apply an amount of conditioning to the center and edge of the wafer proportional to the amount of polishing that is done at the center and edge of the wafer. This smoothing of the fixed-abrasive pad center more than the edges preferably provides a method for maintaining within-wafer removal rate uniformity when polishing wafers using the fixed-abrasive method. This "zonal conditioning" method can be applied before or during polishing of every wafer. It will also be applicable for a system that polishes multiple wafers all at once.

Figure 6:
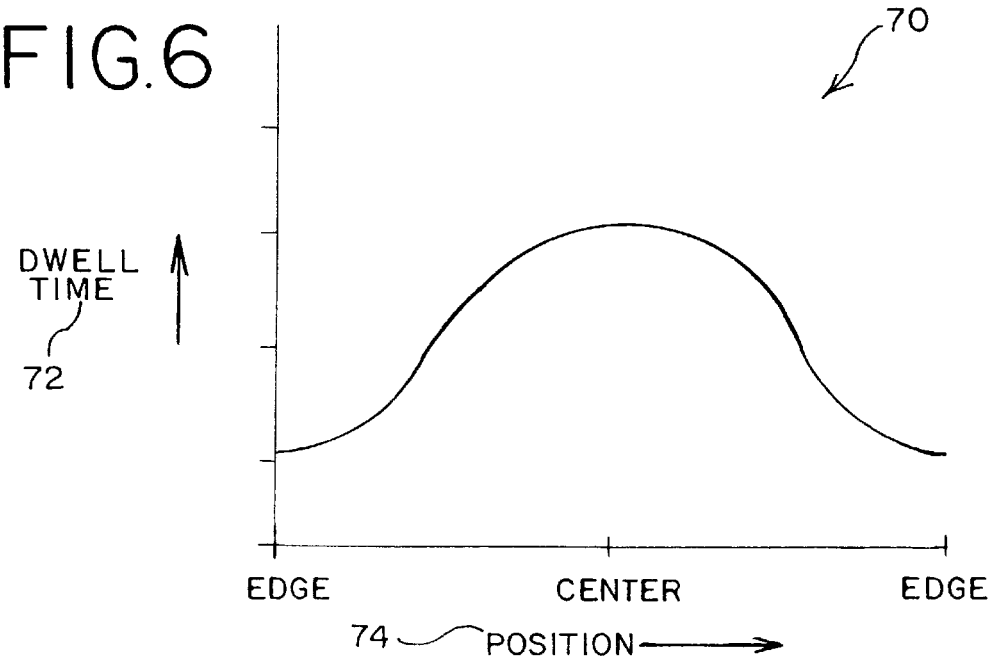
FIG. 6 is graph illustrating pad conditioner dwell time according to a preferred embodiment.
Figure 7:
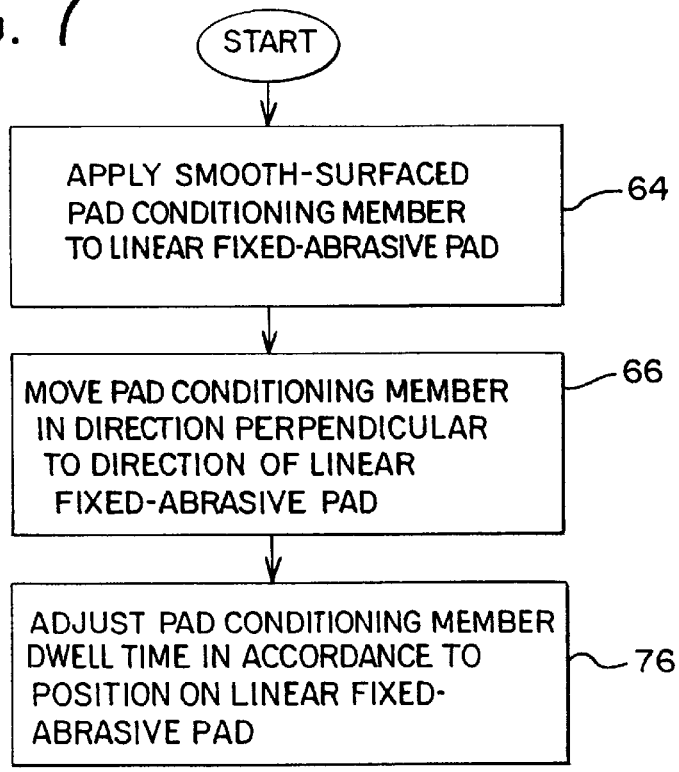
FIG. 7 is a flow chart illustrating a method of conditioning a fixed abrasive polishing pad according to a preferred embodiment.

Referring to FIGS. 5–7, an embodiment of the zonal conditioning technique is illustrated. With the linear belt assembly 14 moving in a continuous linear direction 22, and while the wafer 20 is pressed against the pad, the pad conditioning element 30 of the pad conditioner 12 is applied to the pad (at 64). Maintaining a downward pressure on the fixed-abrasive polishing pad, the actuator mechanism 42 moves the pad conditioning element in a perpendicular direction to the direction of movement of the linear fixed-abrasive pad (at 66). Referring to FIG. 5, the perpendicular direction is indicated by arrow 68. In one preferred embodiment, a pressure of between 0.5 and 4.0 pounds per square inch (p.s.i.), and more preferably 1.0 p.s.i., is applied by the conditioner against the fixed-abrasive pad. Also, the conditioning member preferably has a height in the range of 0.5 mm to 1.0 cm.

As indicated in FIG. 6, a chart 70 of the dwell time 72 relative to the pad conditioning element's position 74 on the pad is preferably adjusted so that more conditioning is applied to the pad in the region oriented with the center of the wafer than in regions closer to the edges of the wafer (at 76). Preferably, the control circuitry for the linear polisher 10 is in communication with the pad conditioner 12 such that the actuator mechanism 42 controlling perpendicular movement of the pad conditioning element 30 may be controlled to achieve this greater dwell time of the pad conditioner 12 in the center of the pad. The variable dwell time of the pad conditioner may be programmed into the linear polisher system in any number of ways. For example, a standard microprocessor and memory may be used to maintain continuous, but variable, movement of the pad conditioner by the actuator mechanism 42. Alternatively, the actuator mechanism may be controlled in discrete steps where the timing of the pad conditioning member's position 74 on the pad is adjusted so that more conditioning is applied to the pad in the region oriented with the center of the wafer than in regions closer to the edges of the wafer (at 76). In either embodiment, the position of the pad conditioner may be continuously monitored and compared to the instructions on timing and/or actuator mechanism speed for a given zone that the pad conditioner presently resides in.

Figure 8:
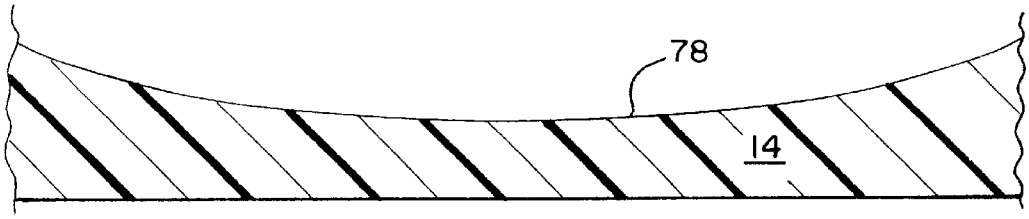
FIG. 8 illustrates a partial cross-section of a fixed-abrasive polishing pad showing some wear.
Figure 9:
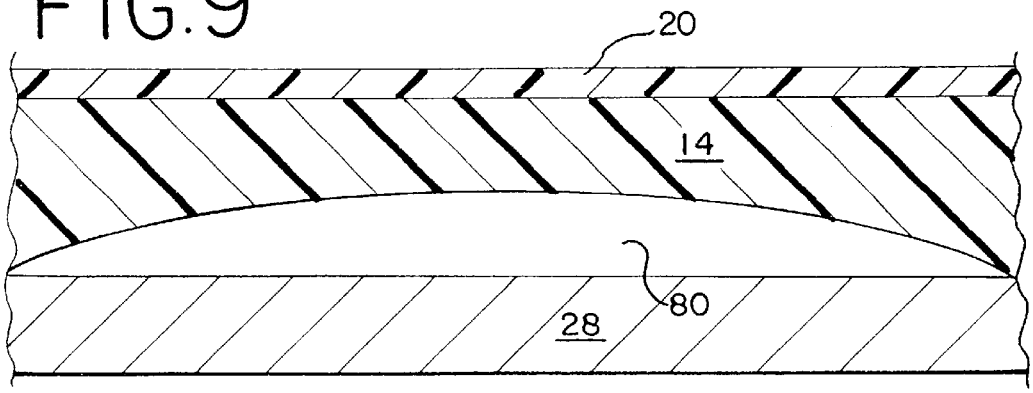
FIG. 9 illustrates the fixed-abrasive polishing pad of FIG. 8 in use on the linear polisher of FIG. 1, where the fluid bearing compensates for pad profile changes due to pad wear.

An example wear profile of a linear belt assembly 14 with a fixed-abrasive polishing pad is illustrated in FIG. 8. A result of the increased wear on the fixed-abrasive pad by the wafer in the center of the pad, as compared to the edges of the pad, is a worn surface 78 represented in FIG. 8 as a concave surface. Because the underside of the linear belt assembly 14 is supported by platen 28 generating a fluid bearing 80, preferably an air bearing, the linear belt assembly 14 presents a substantially flat profile against the surface of the wafer 20 when the wafer is pressed against the pad. As illustrated in FIG. 9, the fluid bearing 80 corrects for the worn surface of the pad with the adjustable cushion of air. Accordingly, the additional wear caused by the pad conditioning member may be used to correct for the extra exposed abrasive in the center of the pad without substantial adverse affect on the profile seen by a semiconductor wafer.

As has been described above, a method and apparatus for conditioning a fixed-abrasive material has been disclosed. The apparatus may consist of a mirror-smooth conditioning member to be rubbed over the fixed-abrasive material with the purpose of wearing down the abrasive particles exposed by action of the patterned devices on the semiconductor wafer. The method includes applying the smooth surface of the conditioning member to the pad while moving the conditioning element perpendicular to the direction the movement of the linear belt. The movement of the pad conditioner is monitored to provide zonal conditioning where dwell time of the pad conditioner is greater in the region of the belt that conditions the center of the wafer than the regions of the belt conditioning the edges of the wafer. The presently preferred method and apparatus has the advantage of using the self-stopping feature of fixed-abrasive pads where, once a sufficiently smooth surface has been achieved on an object, the fixed-abrasive pad will no longer provide newly exposed abrasive particles, and any exposed abrasive particles will wear away. Unlike abrasive pad conditioning mechanisms which may be more difficult to use and ensure even exposure of new abrasive, and more complicated methods of preparing polishing pads with different distributions of abrasives in the center and edge of the pad, the presently preferred embodiments may offer a simpler and more predictable mechanism by which to condition a fixed-abrasive polishing pad to maintain polishing rate and polishing uniformity in a CMP process over an entire wafer.

It is intended that the foregoing detailed description be regarded as illustrative, rather than limiting, and that it be understood that the. following claims, including all equivalents, are intended to define the scope of this invention.

We claim:

1. An apparatus for conditioning a fixed-abrasive polishing pad used in chemical mechanical planarization of semiconductor wafers, the apparatus comprising:

a linear belt comprising a fixed-abrasive polishing pad; and a pad conditioner assembly positioned adjacent the fixed-abrasive polishing pad and adapted to engage a surface of the fixed-abrasive polishing pad, wherein the pad conditioner assembly comprises:

a conditioning member connected to a pad conditioner carrier, wherein the conditioning member comprises a continuous, non-abrasive surface configured to wear down exposed abrasive particles in the fixed-abrasive polishing pad and oriented toward the fixed-abrasive polishing pad.

2. The apparatus of claim 1, wherein the conditioning member has a diameter less than a diameter of a semiconductor wafer to be polished by the fixed-abrasive pad.

3. The apparatus of claim 1, wherein the conditioning member has a diameter substantially equal to a diameter of a semiconductor wafer to be polished by the fixed-abrasive pad.

4. The apparatus of claim 1, wherein the conditioning member is formed in the shape of a bar.

5. The apparatus of claim 1, wherein the conditioning member is formed in the shape of a disc.

6. An apparatus for conditioning a fixed-abrasive polishing pad used in chemical mechanical planarization of semiconductor wafers, the apparatus comprising:

a linear belt comprising a fixed-abrasive polishing pad; and a pad conditioner assembly positioned adjacent the fixed-abrasive polishing pad and adapted to engage a surface of the fixed-abrasive polishing pad, wherein the pad conditioner assembly comprises:

a conditioning member connected to a pad conditioner carrier, wherein the conditioning member comprises a continuous, non-abrasive surface oriented toward the fixed-abrasive polishing pad, wherein the conditioning member comprises a material selected from the group consisting of silicon oxide and silicon carbide.

7. An apparatus for conditioning a fixed-abrasive polishing pad used in chemical mechanical planarization of semiconductor wafers, the apparatus comprising:

a linear belt comprising a fixed-abrasive polishing pad; and a pad conditioner assembly positioned adjacent the fixed-abrasive polishing pad and adapted to engage a surface of the fixed-abrasive polishing pad, wherein the pad conditioner assembly comprises:

a conditioning member connected to a pad conditioner carrier, wherein the conditioning member comprises a continuous, non-abrasive surface oriented toward the fixed-abrasive polishing pad, wherein the conditioning member comprises a material selected from the group consisting of borosilicate glass, soda lime glass, high-lead glass, silicon oxide, and quartz.

8. A method for conditioning a fixed-abrasive polishing pad used in chemical mechanical planarization of semiconductor wafers, the method comprising:

providing at least one pad conditioner having a conditioning member comprising a smooth surface oriented to contact the fixed-abrasive polishing pad;

pressing the conditioning member against the fixed-abrasive polishing pad;

moving the fixed-abrasive polishing pad; and wearing down exposed abrasive particles in the fixed-abrasive polishing pad with the conditioning member while avoiding exposure of additional abrasive particles.

9. The method of claim 8, wherein the fixed-abrasive polishing pad comprises the abrasive particles embedded within a polymer matrix.

10. The method of claim 8, wherein the conditioning member is applied to the fixed-abrasive polishing pad while a semiconductor wafer is being polished on the fixed-abrasive polishing pad.

11. The method of claim 8, further comprising rotating the conditioning member.

12. The method of claim 8, wherein the pressing of the conditioning member is conducted with a force of between about 0.5 psi and about 4.0 psi.

13. The method of claim 8, wherein the conditioning member is removably attached to a retaining fixture.

14. The method of claim 8, wherein the conditioning member has a height of between about 0.5 millimeters and about 1.0 centimeter.

15. A method for conditioning a fixed-abrasive polishing pad used in chemical mechanical planarization of semiconductor wafers, the method comprising:

providing at least one pad conditioner having a conditioning member comprising a smooth surface oriented to contact the fixed-abrasive polishing pad;

pressing the conditioning member against the fixed-abrasive polishing pad; and moving the fixed-abrasive polishing pad, wherein the conditioning member comprises a material selected from the group consisting of borosilicate glass, soda lime glass, high-lead glass, and silicon oxide.

16. A method for conditioning a fixed-abrasive polishing pad used in chemical mechanical planarization of semiconductor wafers, the method comprising:

providing at least one pad conditioner having a conditioning member comprising a smooth surface oriented to contact the fixed-abrasive polishing pad;

pressing the conditioning member against the fixed-abrasive polishing pad; and moving the fixed-abrasive polishing pad, wherein the conditioning member is moved across the fixed-abrasive polishing pad at a variable rate of speed based on a location of the conditioning member on the fixed-abrasive polishing pad.

17. A method for conditioning a fixed-abrasive polishing pad used in chemical mechanical planarization of semiconductor wafers, the method comprising:

providing at least one pad conditioner having a conditioning member comprising a smooth surface oriented to contact the fixed-abrasive polishing pad;

pressing the conditioning member against the fixed-abrasive polishing pad; and moving the fixed-abrasive polishing pad, wherein the conditioning member is moved to each of a number of discrete positions across the fixed-abrasive polishing pad, and wherein the conditioning member remains at positions closer to a center of the polishing pad for a longer time than at positions closer to an edge of the polishing pad.

18. A method for conditioning a fixed-abrasive polishing pad used in chemical mechanical planarization of semiconductor wafers, the method comprising:

moving the fixed-abrasive polishing pad comprising abrasive particles held in a polymer matrix;

pressing a pad conditioning member against the moving polishing pad; and wearing down exposed abrasive particles in the polishing pad to adjust a removal rate of the polishing pad.

19. The method of claim 18, further comprising adjusting a position of the pad conditioning member on the polishing pad in a direction perpendicular to a direction of movement of the polishing pad at a variable rate.

20. The method of claim 19, further comprising maintaining the pad conditioning member parallel to the polishing pad while pressing the pad conditioning element against the polishing pad.

* * * * *